US009045870B2

(12) United States Patent
Buschmann et al.

(10) Patent No.: US 9,045,870 B2
(45) Date of Patent: Jun. 2, 2015

(54) ROAD FINISHING MACHINE AND METHOD FOR LAYING MIXED MATERIAL WITH A ROAD FINISHING MACHINE

(71) Applicant: Joseph Vogele AG, Ludwigshafen/Rhein (DE)

(72) Inventors: Martin Buschmann, Neustadt (DE); Klaus Oettinger, Altlussheim (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 56 days.

(21) Appl. No.: 13/886,558

(22) Filed: May 3, 2013

(65) Prior Publication Data

US 2013/0322964 A1 Dec. 5, 2013

(30) Foreign Application Priority Data

Jun. 5, 2012 (EP) ..... 12004275

(51) Int. Cl.
*E01C 23/07* (2006.01)
*E01C 19/48* (2006.01)

(52) U.S. Cl.
CPC ..... *E01C 19/4866* (2013.01); *E01C 19/48* (2013.01)

(58) Field of Classification Search
CPC ..... E01C 19/48; E01C 19/00; E01C 19/42; E01C 19/185
USPC ..... 404/83, 84.05, 101, 108; 701/50
See application file for complete search history.

(56) References Cited

U.S. PATENT DOCUMENTS

| | | | | |
|---|---|---|---|---|
| 5,938,371 | A | 8/1999 | Gustin et al. | |
| 6,099,616 | A * | 8/2000 | Jenne et al. | 95/1 |
| 6,584,920 | B1 * | 7/2003 | Cresswell | 111/174 |
| 6,749,364 | B1 * | 6/2004 | Baker et al. | 404/84.5 |
| 6,832,872 | B2 * | 12/2004 | Koelm et al. | 404/108 |
| 7,077,601 | B2 * | 7/2006 | Lloyd | 404/85 |
| 7,491,012 | B2 * | 2/2009 | Weiser | 404/108 |
| 2003/0156043 | A1 * | 8/2003 | Doescher et al. | 340/901 |
| 2003/0194273 | A1 * | 10/2003 | Lloyd | 404/83 |
| 2010/0326067 | A1 * | 12/2010 | Weiser et al. | 60/329 |
| 2013/0058719 | A1 * | 3/2013 | Warlow et al. | 404/92 |

FOREIGN PATENT DOCUMENTS

WO WO2007043966 A1 4/2007

OTHER PUBLICATIONS

European Search Report mailed Dec. 13, 2012, which issued in corresponding EP Application No. EP12004275.

* cited by examiner

*Primary Examiner* — Abigail A Risic
(74) *Attorney, Agent, or Firm* — Fish & Richardson P.C.

(57) ABSTRACT

In a road finishing machine comprising at least one screed, a machine control, and a ventilation system including a fan, the fan can be switched on or off via the machine control automatically independent of the operator and exclusively depending on demand. According to the invention, before or during the laying operation, a defined demand for the operation of the ventilation system is determined, and during or for the laying operation, the ventilation system is operated independent of the operator and automatically, and optionally power-controlled, upon determination of the defined demand.

9 Claims, 2 Drawing Sheets

Figure 1:
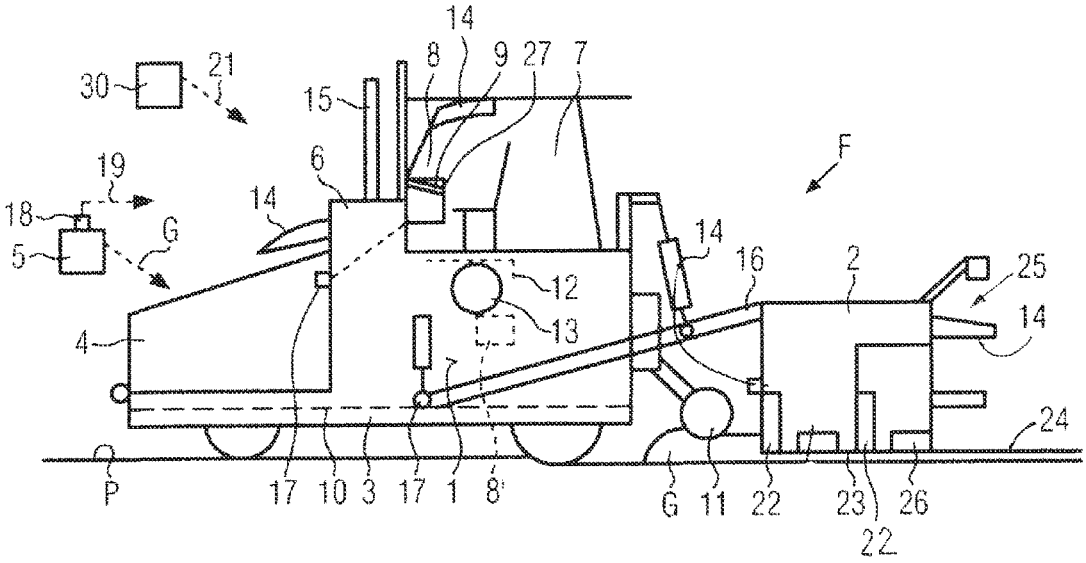

ROAD FINISHING MACHINE AND METHOD FOR LAYING MIXED MATERIAL WITH A ROAD FINISHING MACHINE

The invention relates to a road finishing machine comprising at least one screed, a machine control, and a ventilation system including at least one fan that can be switched on and off, and to a method for laying a material mixture, to be rolled, on a foundation by a road finishing machine with a screed, the road finishing material comprising a machine control and a ventilation system including at least one fan that can be switched on and off.

Modern road finishing machines employed on the market have a ventilation system with an uncontrolled fan that can be switched on and off to collect and discharge vapors and aerosols during the laying operation, for example from asphalt to be rolled in road construction, such that operators of the finishing machine or its screed have more comfortable working conditions, and the direct surroundings on the construction site are relieved by the purposeful discharge of such irritants. Certain machine functions and operating modes of the road finishing machine and the screed depend on the respective material mix. Asphalt to be rolled after being laid, for example in road construction, is laid as a mixture material bound with bitumen with a defined laying temperature of usually far above 100° C., necessitating that the heating devices of the screed are also driven at corresponding high power. Thereby, vapors and aerosols, for example from the bitumen, are increasingly released. In hydraulically bound material mixtures, to the contrary, hardly any vapor and aerosol are released, which is also because the heating devices of the screed are not operated, or only operated moderately. The same applies to concrete material mixtures. Here, the operation of the ventilation system does not make sense, just as during the site-changing operation or transport drives of the road finishing machine without material mixtures.

In known road finishing machines, two different operating modes for the ventilation system are common. The ventilation system is either basically switched on and kept switched on without control as long as the primary drive source, i.e. the diesel engine, is running, or the ventilation system is switched on and off from case to case by an operator who judges the necessity of the operation of the ventilation device in his/her own discretion. Since the ventilation system does not only have a considerable energy demand, e.g. quite 10 kW, but the operation of the ventilation system only really makes sense for certain types of material mixtures or material mixture temperatures or operating modes of the road finishing machine, the first operating mode means a bad energy balance for the road finishing machine, and inappropriate noise pollution also during the site-changing operation of the road finishing machine or during the transport phase without a material mixture onboard. In the second operating mode, the reasonable use of the ventilation system also depends on the judgment, the attention, and also the benevolence of the operator, i.e. a human factor which does not always guarantee an efficient and reasonable use of the ventilation system. The distinct noise pollution by the fan and a discharging pipe often induces the operator not to operate the ventilation system although it would basically make sense. Moreover, operators often tend to forget or omit to switch off the ventilation system due to external influences. Furthermore, borderline cases might occur where operators are not sure whether an operation of the ventilation system makes sense or not, because no clear or meaningful information are available. The ventilation system is then either not switched on although it would make sense, or switched on although it does not make sense.

A road finishing machine with a ventilation system is known from U.S. Pat. No. 5,938,371 A. In this road finishing machine, the tunnel of the longitudinal conveyor is embodied in the top region with a double wall, so that here an exhaust channel extends to the fan from which channel a discharging pipe extends upwards over the driver stand of the road finishing machine. Suck-in hoods placed for example above the material mixture hopper, above the transverse spreading auger, and optionally at or behind the screed collect and suck in vapors and aerosols and are connected to the exhaust channel,.

The object underlying the invention is to provide a road finishing machine and a method which are improved in view of their energy efficiency or energy balance with respect to the use of a ventilation system and which permit an increase of comfort and a relief of operators.

This object is achieved with the apparatus and method of the present invention.

Since the ventilation system and its fan, respectively, can automatically be at least switched on or off depending on a determined demand via the machine control or a separate ventilation system control, operators do not have to intervene, and the ventilation system is only operated when this actually makes sense. In this manner, the energy balance of the road finishing machine is improved as the ventilation system is only operated when an appreciable amount of vapors or aerosols and the like are released, and the working conditions for the operator are optimized and the direct surroundings protected.

According to the method, first, a previously defined demand for the operation of the ventilation system or the fan is determined, and the ventilation system or the fan is at least automatically switched on only upon the determination of the defined demand and optionally operated at least for the duration of the present demand. The demand is determined based on the operating mode or machine function of the road finishing machine and/or the type of material mixture and/or the temperature of the material mixture. The operator is discharged from his decision of operating the ventilation system or not, and he can nevertheless utilize the ventilation system if its application makes sense, while he will not be bothered or affected by the operating noise of the ventilation system when an operation of the ventilation system indeed does not make sense as the latter remains switched off.

The machine control or the ventilation system control comprises a demand decision section by which information preferably acquired, available, or present can be processed, which information originate from or correspond to material mixture type and/or an adjusting device for an operating mode and/or machine function preselection device, and/or a temperature measuring device of the road finishing machine and/or an irritant concentration. This information is meaningful and reliable, and this even in borderline cases an operator would possibly be unable to cope with, and result in a switching on of the ventilation system only when its operation really makes sense based on the available information.

In a suitable embodiment, the road finishing machine comprises at least one measuring device for the actual value of the material mixture temperature and/or the laying temperature and/or the screed temperature and/or the irritant concentration. The measuring device may be situated preferably in the region of a material hopper and/or a longitudinal conveyor and/or the screed and/or a sucking region to reliably detect the respective actual temperature or actual concentration and to use it for the decision of whether the ventilation system should be at least switched on or off.

Suitably, at least in the machine control, a preferably operator-controlled input and/or display section for material mixture types and/or material mixture temperatures and/or laying temperatures and/or compacting settings and/or screed heating temperatures and/or a target value of an irritant concentration in a sucking area are provided by which required information can be supplied to the decision section. In the input and/or display section, operating modes, machine functions, the heating power of screed heating devices or the like can also be adjusted or displayed and directly converted into meaningful information for the decision section.

In a suitable embodiment, at least the machine control is linked or can be linked online or from case to case with a construction site management system supplying information for the decision on the need or lacking need, which system provides definitive information e.g. in a planning office that has such information ready which the road finishing machine or its machine control, respectively, can utilize for automatically switching on or off the ventilation system in view of optimal energy efficiency.

In a suitable method variant, the demand for the operation of the ventilation system is defined with reference to at least one selected parameter of the material mixture type intended for laying, and/or in allocation to a machine function and/or operating mode selectable for laying, and/or a determination of state or a measurement performed or selected in the road finishing machine, preferably in an automated way in a decision section of the machine control or a ventilation system control.

It can furthermore be suitable to use, as machine function of the road finishing machine defining the demand, the operation and/or at least a predetermined power stage of a screed heating device and/or a material mixture classification setting preselection, for example for compaction tools of the screed, and/or a measured actual irritant concentration compared to a target value.

The measured actual irritant concentration could optionally be used for automatically switching on and/or switching off the ventilation system.

As an alternative or in addition, the material mixture laying temperature or actual screed temperature or screed temperature preselection above a predetermined temperature value, preferably approximately 100° C. or more, can be used as the determination of state or measurement defining the demand.

Here, the machine control or the ventilation system control or the decision section can be designed or programmed such that the fan is automatically switched off at least during site-changing operations and/or transport drives of the road finishing machine which are performed e.g. without a material mixture, and remains switched off until a new demand for the operation of the ventilation system is determined.

The power of the ventilation system and/or the speed of the fan is suitably controlled, for example by comparing a target value and at least one measured actual value of the irritant concentration e.g. in a sucking region of the road finishing machine. The power is controlled automatically or by the operator such that just as much irritants are sucked away as is necessary. By this, noise pollution also remains at a minimum in situations where less irritants are being released.

Control is suitably performed automatically, e.g. also by consulting further meaningful information, and optionally with a follow-up phase during which the ventilation system executes an after-run, even if no laying material is being processed any longer.

For all of this, the power of the fan may be controllable, e.g. by use of a speed-controlled electric or hydraulic drive motor, and a control unit should be linked to the control device.

Figure 6:
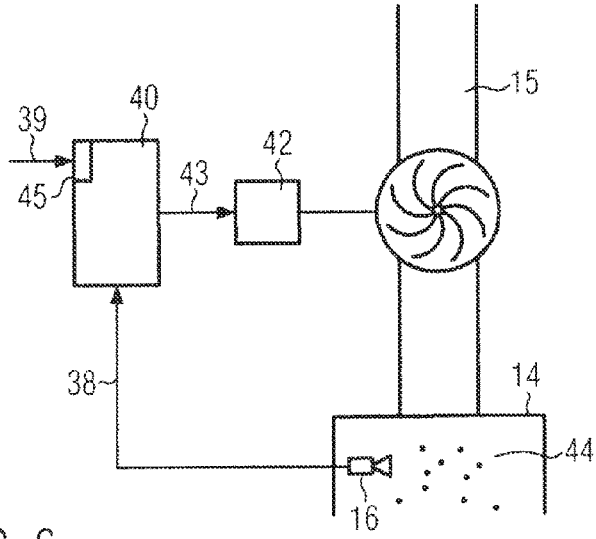

Embodiments of the subject matter of the invention will be illustrated with reference to the drawing. In the drawing:

FIG. 1 shows a schematic side view of a road finishing machine being used on a construction site during laying a surfacing of a material mixture onto a foundation, FIGS. 2 to 5 show several method flow charts for automatically switching on or off a ventilation system of the road finishing machine, and FIG. 6 shows a detail variant.

A road finishing machine F schematically shown in FIG. 1 comprises a self-propelled tractor 1 being operated at a low driving speed during a laying process or at a faster driving speed during transport and site-changing drives. At least one screed 2 is towed by the tractor 1 for laying a surfacing 24 of a material mixture G during the laying drive of the road finishing machine F. The road finishing machine F has a material hopper 4 at the front side in a chassis 3 which hopper 4 can be filled with the material mixture G, for example from a dump truck, from a conveyor belt or from a charge vehicle 5. A longitudinal conveyor 10 extends at the bottom side to a rear end of the chassis 3. Behind the material bunker 4, a primary drive source 6, for example a diesel engine, is arranged behind which a driver stand 7 equipped with a machine control 8 is disposed on the chassis 3. The machine control 8 comprises, among other things, a decision section 9 and preferably an input and display section 27, and is, for example, connected with an on-board ventilation system 12 of the road finishing machine F, and with further, not particularly distinguished functional assemblies of the road finishing machine F and/or the screed 2. The ventilation system 12 comprises at least one fan 13 that can be switched on and off, non-depicted channels, for example to diverse sucking devices 14, for example situated in the region of the material hopper 4, in the region of the longitudinal conveyor 10, at the rear end of the chassis 3 and in the region of the screed 2, as well as a discharging pipe 15 extending upwards over a roof of the driver stand 7.

The ventilation system 12 is provided for taking-in, together with ambient air, vapors and aerosols and the like which are released in operation from the material mixture G inside the road finishing machine F and optionally also behind the screed 2, and for discharging them via the discharging pipe 15 to the top, e.g. through a non-depicted filter device, away from operators working on and next to the road finishing machine F and the screed 2, and also away from the direct surroundings of the road finishing machine F by sucking off these collected irritants and discharging them to the top (or the rear).

At the rear end of the chassis 3, a transverse material mixture distribution device 11, e.g. a lateral auger, is disposed which distributes the material mixture G thrown off by the longitudinal conveyor 10 onto a foundation P (underground) in front of the screed 2. The screed 2 (a standard screed of a fixed basic width, or an extendable screed of variable working width) is coupled with beams 16 to the chassis 3 at lateral coupling points 17. The screed 2 comprises a screed plate 23 and a tampering device 22. Screed heating devices 26, e.g. electric heating devices, also are provided which are supplied with electric power by a three-phase generator driven by the primary drive source 6 and are set and controlled via the machine control 8 to certain heating power stages or heating temperatures. At the screed 2, at least one external control stand 25 can be disposed at which an operator may adjust operating modes or machine functions at least of the screed 2, but optionally also of the road finishing machine F, like also directly at the machine control 8 in the driver stand 7.

Furthermore, at least one measuring device 16, 17, 18 (a temperature sensor) can be provided which supplies e.g. measured temperature values to the machine control 8. In the shown embodiment, e.g. at least one temperature measuring device 16 is disposed in the region of the screed 2 to measure the laying temperature. And/or a temperature measuring device 17 may be situated in the region of the material hopper 4 to measure the material mixture temperature, or else in the region of the longitudinal conveyor 10 (not shown), and/or in the dump truck or charge vehicle 5 supplying the material mixture G. The material mixture temperature is reported, for example wirelessly or in a cable-bound manner, as information 19 to the machine control 8. As an alternative or in addition, at least one measuring device 16 can be used for determination of the actual concentration of irritants, e.g. in an sucking region 44 (FIG. 6).

Furthermore, at least the machine control 8 can be linked or is linkable online or as required with a construction site management system 20 (server or computer) from which information 21 concerning the type of material mixture and/or the material mixture temperature and/or the laying temperature, and/or certain operating modes, and/or certain machine functions of the road finishing machine or the screed and/or certain compaction preselection settings or target values for the irritant concentration can be supplied and for example processed in the decision section 9 to determine whether, for the already started or upcoming laying operation, the ventilation system 12 or its fan 13 should be switched on because it makes sense, or should not be switched on or should be switched off when already running. Information that are input at the input and display section 27 of the machine control 8, for example by an operator, can also be processed in the decision section 9 to make a decision whether the ventilation system 12 should be automatically switched on or off.

As an alternative, the ventilation system 12 could comprise a separate ventilation system control 8' which switches on the ventilation system 12 or its fan 13, respectively, automatically and independent of the operator when this makes sense due to a detected demand, or switches it off when there is no demand. Suitably, the power or speed of the fan 13 can be regulated.

Whether or not the operation of the ventilation system 12 does make sense or should be regulated depends from certain operating states or machine functions of the road finishing machine or the screed, and/or certain types of material mixtures and/or certain material mixture temperatures and also from an optionally measured irritant concentration. These are decisive parameters for determining the demand for the operation and optionally a regulation of the ventilation system. The machine control 8 (or the ventilation system control 8') automatically switches on the ventilation system 12 or the fan 13, respectively, after the decision has been made and the demand has been determined, and keeps it e.g. switched on and regulates it optionally as long as the demand is present. In contrast, the ventilation system 12 and its fan 13 are switched off or kept switched off as long as no demand is detected or no demand is detected any longer.

Presettings of the compaction generated by the compaction tools of the screed 2 in the surfacing 24 can be preselected at the machine control and can also be utilized as a meaningful parameter for the decision. Material mixture types which are bound with bitumen and must be laid at defined elevated laying temperatures or with elevated material mixture temperatures of, for example, more than 100° C., also represent a parameter defining a demand. Hydraulically bound material mixture types or concrete material mixtures, however, often do not require the operation of the ventilation system 12, as also an operating mode of the road finishing machine with low material mixture temperatures below approximately 100° C., or types of material mixtures without bitumen binding which are processed and laid at ambient temperature. Since then also the heating devices of the screed 2 need not be operated or only need to be operated moderately, this fact can also be utilized as a parameter for finding a decision. Furthermore, when the road finishing machine travels to change from one site to another (site changing operation), or during a transport phase without material mixture onboard, the operation of the ventilation system 12 does not make sense, so that these operating modes, too, can be processed as parameters for the decision of switching off the ventilation system 12. The measured actual irritant concentration can be consulted as alternative information or in addition.

Figure 2:
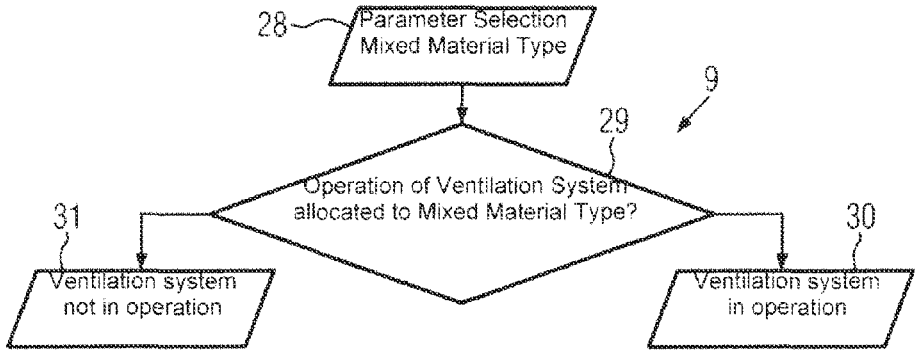

In the flow chart in FIG. 2, a choice among available parameters to the type of the material mixture is made according to the method in block 28, for example in the decision section 9, and upon selection in block 29, it is requested whether the operation of the ventilation system can be allocated to the type of material mixture. If the answer to this request is "Yes", the ventilation system is put in operation in block 30 and operated until the answer is "No". If, however, the answer is "No" from the beginning, the ventilation system 12 remains out of operation in block 31.

Figure 3:
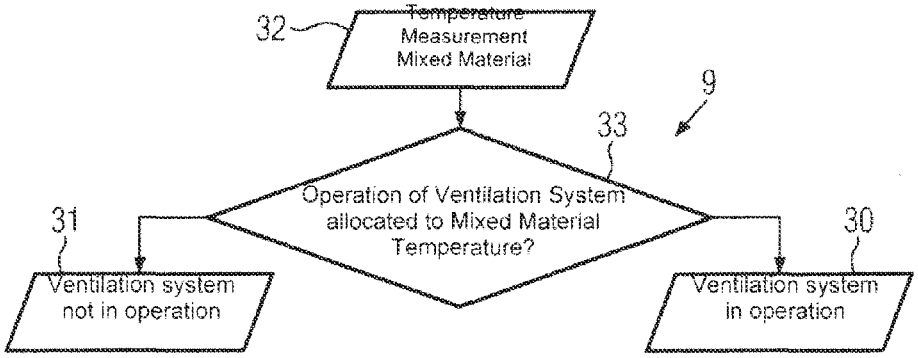

In the method variant in FIG. 3, in block 32, the measurement of the temperature of the material mixture or the information on the material mixture temperature is processed, and in block 33, it is requested whether the operation of the ventilation system is allocated to the material mixture temperature. If the answer is "Yes", the ventilation system is put in operation and kept in operation in block 30. If the answer is "No", the ventilation system is not put in operation or is switched off in block 31.

Figure 4:
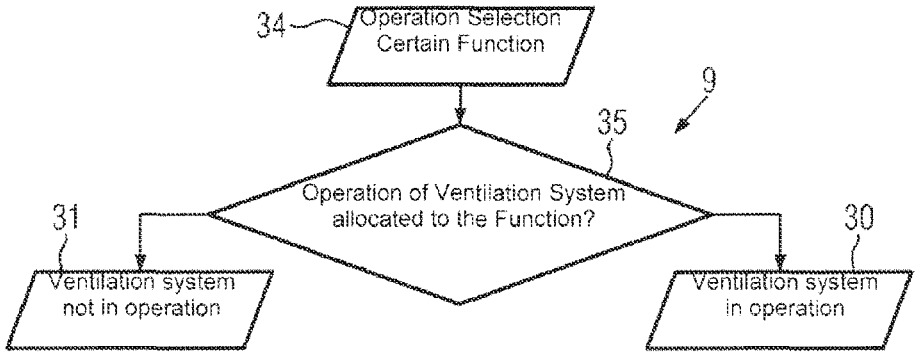

In the method variant in FIG. 4, a selection of a certain machine function is made in block 34, and in block 35, it is requested whether the operation of the ventilation system is allocated to the machine function. If the answer is "Yes", the ventilation system is put in operation in block 30. If the answer is "No" in block 35, the ventilation system is not put in operation or switched off in block 31.

Figure 5:
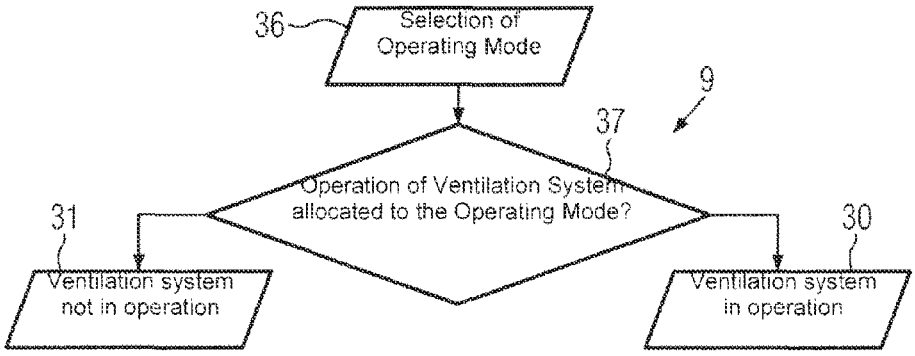

In the embodiment in FIG. 5, a selection of the operating mode of the road finishing machine or the screed, respectively, is made in block 36, and this choice is submitted to block 37. In block 37, it is requested whether the operation of the ventilation system is allocated to the selected operating mode. If the answer is "Yes", the ventilation system is put in operation and kept in operation in block 30. If the answer is "No", the ventilation system is not put in operation or switched off in block 31.

Although an operator can make inputs or request operating conditions at the machine control 8 (or the ventilation system control 8', respectively), the decision of switching on and/or regulating or switching off or keeping switched on or keeping switched off the ventilation system 12 is suitably made independent of the operator and automatically via the decision section 9, i.e. first the demand that the ventilation system is to be in operation is determined. If no demand is detected or no more demand determined, the ventilation system 12 is automatically not put in operation at all or switched off. Optionally, the ventilation system is automatically also operated for a follow-up phase (after-run operation) before it is switched off totally.

FIG. 6 shows, as a detail variant, a speed- and/or power-controllable fan 13 whose drive 42 (e.g. an electric or hydraulic motor) is controlled by a controller 40 which compares an actual irritant concentration value 38 measured by the measuring device 16, e.g. in a sucking region 44, with a target value 39 provided or input at an input section 45, and adjusts the power 43 correspondingly.

The speed of the fan 13 will then only be just as high as required. For the decision, the actual irritant concentration value 38 could be used alone or in connection with the mentioned other information for the decision, or for switching on or off the ventilation system 12 and/or regulating it according to demand. This involves a desirable saving of energy, often reduces the operating noise of the ventilation system 12 and above all avoids an unsuitably strong cooling of the laying material mixture when the fan speed and the air flow rate are low, for example when the laying process is interrupted for a while.

The invention claimed is:

1. Road finishing machine comprising at least one screed, a machine control, and a ventilation system for drawing in and discharging collected irritants released by a material mixture processed by the road finishing machine, the ventilation system including at least one fan that can be switched on and off, automatically exclusively depending on a demand for the operation of the fan of the ventilation system determined by a machine control or a ventilation system control, wherein the machine control or the ventilation system control comprises a ventilation system operation demand decision section that acquires and processes information one or more of a material mixture type, an operating mode of the screed or the road finishing machine, from a road finishing machine function pre-selection or setting device or from a temperature measuring device of the road finishing machine, to automatically decide whether or not to demand operation of the fan of the ventilation system.

2. Road finishing machine according to claim 1, wherein the road finishing machine comprises at least one device for measuring an actual value of the temperature of the material mixture, and/or a material mixture laying temperature a screed heating temperature or an irritant concentration, the device being situated in the region of a material hopper a longitudinal conveyor, the screed or an irritant withdrawing region of the road finishing machine.

3. Road finishing machine according to claim 1, wherein the machine control comprises an operator-controlled input section for entering information on one or more of material mixture types, material mixture temperatures, material mixture laying temperatures, compaction settings of compacting tools of the screed, screed heating temperatures, operating modes or machine functions of the road finishing machine.

4. Road finishing machine according to claim 1, wherein at least the machine control is linked online to a construction site management system for acquiring information on material mixture types and/or or the ventilation system operation demand decision section.

5. Road finishing machine according to claim 1, wherein an irritant concentration measuring device is provided in an irritant collecting region of the road finishing machine, and is linked to one of a device for switching the ventilation system fan fan on or switching-off or a ventilation system fan power control device.

6. Method for laying an asphalt material mixture on a foundation by a road finishing machine having a screed and further comprising a machine control and a ventilation system for collecting and discharging irritants released from the material mixture processed by the road finishing machine, the ventilation system including at least one fan that can be switched-on and off, the method comprising determining a demand for operation of the ventilation system before or during the laying operation based on an operating mode or machine function of the road finishing machine, a material mixture type, a material mixture temperature, or an irritant concentration, and switching-on the fan automatically and operating the ventilation system at least for the duration of the determined demand.

7. Method according to claim 6, comprising determining and implementing the demand for operation of the ventilation system independent of an operator with the machine control or a ventilation system control.

8. Method according to claim 6, comprising automatically switching-off the fan during a site-changing operation or a transport travel of the road finishing machine.

9. Method according to claim 6, comprising automatically controlling the speed of the fan of the ventilation system on the basis of a comparison executed between a set target value and a measured actual value of an irritant concentration.

* * * * *